US006189249B1

(12) United States Patent
Hughes

(10) Patent No.: US 6,189,249 B1
(45) Date of Patent: Feb. 20, 2001

(54) SECURITY TAG DEVICE

(76) Inventor: Christopher V. Hughes, 10320 Devonshire Cir., Bloomington, MN (US) 55431

( * ) Notice: Under 35 U.S.C. 154(b), the term of this patent shall be extended for 0 days.

(21) Appl. No.: 08/991,421

(22) Filed: Dec. 16, 1997

(51) Int. Cl.[7] ..... G09F 3/08; A44B 1/04; E05B 67/38; B65D 27/30

(52) U.S. Cl. ..... 40/662; 40/664; 40/625; 40/632; 24/387; 24/390; 70/68; 292/307 A

(58) Field of Search ..... 40/662, 664, 625, 40/632; 292/318, 321, 322, 307 A, 308 B, 307 R; 24/387, 390; 70/68

(56) References Cited

U.S. PATENT DOCUMENTS

| | | | | |
|---|---|---|---|---|
| 2,578,035 | * | 12/1951 | Bashover | 24/387 X |
| 2,655,747 | * | 10/1953 | Duskin | 40/662 |
| 3,678,608 | * | 7/1972 | Minasy | 40/662 |
| 3,971,458 | * | 7/1976 | Koenig | 24/387 X |
| 3,987,876 | | 10/1976 | Foults | 190/170 |
| 4,366,684 | | 1/1983 | Bako et al. | 70/68 |
| 4,489,832 | | 12/1984 | Helms | 206/387.1 |
| 4,531,670 | | 7/1985 | Kupersmit | 229/125.21 |
| 4,682,688 | | 7/1987 | Budert | 206/1.5 |
| 4,711,372 | | 12/1987 | Gach | 222/23 |
| 4,727,668 | * | 3/1988 | Anderson et al. | 40/625 |
| 4,793,504 | | 12/1988 | Towns et al. | 215/250 |
| 4,815,176 | * | 3/1989 | Yoshida | 24/387 |
| 4,966,470 | | 10/1990 | Thompson et al. | 383/61 |
| 5,031,944 | * | 7/1991 | Keyaki | 292/307 R |
| 5,125,700 | * | 6/1992 | Fattori et al. | 282/318 |
| 5,163,191 | * | 11/1992 | Chan | 24/387 X |
| 5,225,162 | | 7/1993 | Scoville | 422/56 |
| 5,373,656 | | 12/1994 | Merser | 40/663 |
| 5,382,528 | * | 1/1995 | Scoville | 292/307 A X |
| 5,560,657 | * | 10/1996 | Morgan | 283/80 |
| 5,568,951 | * | 10/1996 | Morgan | 292/307 A |
| 5,725,261 | * | 3/1998 | Rahn | 292/307 R |
| 5,791,079 | * | 8/1998 | Mazzucchelli | 40/625 |

* cited by examiner

*Primary Examiner*—James R. Brittain
*Assistant Examiner*—Robert L. Pilaud
(74) *Attorney, Agent, or Firm*—Patterson, Thuente & Skaar

(57) ABSTRACT

A tamper-proof seal assembly for discouraging and detecting tampering of containers onto which the tamper-proof seal assembly is installed. The container includes a closure assembly. The closure assembly defines an opening. The tamper-proof seal assembly includes a security tag and a button assembly. The security tag includes a flag and a stem. The flag and stem are integral but are easily severable. The button assembly includes an outer button and an inner button. The button assembly is mounted on the container proximate the closure assembly. The stem is inserted through the closure assembly opening and into the button assembly, where the stem is secured against withdrawal by a ratchet.

15 Claims, 4 Drawing Sheets

SECURITY TAG DEVICE

FIELD OF THE INVENTION

The present invention relates to devices which discourage and detect tampering. More specifically, it relates to an innovative combination in which a security tag and a tag-receiving receptacle are used to maintain a container closure mechanism in a closed configuration until a flag portion of the security tag is separated from the tag stem portion.

BACKGROUND OF THE INVENTION

Security devices for containers are well known. These security devices include various locks and seals. It is frequently desirable for containers to be secured in a closed configuration to discourage or at least detect tampering. While locks for containers are well known, users often find them inconvenient. Seals are well known for use with cargo containers. However, seals usually require specialized tools for installation and removal. Thus, it would be desirable to provide a device which would both discourage and detect tampering of a container, that could be easily used without tools.

SUMMARY OF THE INVENTION

The problems outlined above are in large measure solved by the tamper-proof security tag device in accordance with the present invention. The tamper-proof device hereof is easily installed on containers, such as luggage, which are closed by zippers, hasps and like devices.

Thus, there is provided a security tag assembly adapted for securing a container. The container may include a first member and a second member. The container may further include structure defining an aperture. The second member may be shiftable between an open orientation and a closed orientation relative to the first member. The security tag assembly may include a tag. The tag may include a stem removably receivable through the container second member aperture. The tag may further include a preventer operably coupled to the stem, the preventer not being receivable through the aperture. The security tag assembly may further include a tag receiving assembly. The tag receiving assembly may include a securing element adapted for fixedly, operably attaching the tag receiving assembly to the container first member. The tag receiving assembly may further include a tag receiving fastener for operably, irreversibly receiving the stem therein. The security tag assembly may be configured whereby the stem can be received through the second member aperture and be lockingly received within the tag receiving fastener when the first and second container members are in the closed orientation, such that shifting the first and second container members to the open configuration must be preceded by the severance of the tag.

There is also provided a security tag assembly. The security tag assembly may include a tag and a tag receiving structure. The tag may include a stem with a cross sectional dimension and a preventer with a cross sectional dimension. A longitudinal axis of the stem may be generally transverse to the cross sectional dimensions of the stem and the preventer. The cross sectional dimension of the stem may be less than the cross sectional dimension of the preventer. The tag receiving structure may unidirectionally receive the stem therein. The tag receiving structure may unidirectionally receive a cross sectional dimension less than the cross sectional dimension of the preventer.

There is also provided a method of installing a tamper-proof seal assembly on a container with a closure assembly.

The closure assembly may define an opening therein. The method may include the step of mounting a first outer button on a first surface of the container, proximate the closure assembly. The method may further include the steps of providing a tag with a stem and a preventer, and inserting the stem through the opening in the closure assembly, the opening accommodating a passage of a portion of the stem therethrough, the opening not accommodating passage of the keeper. The method may further include the step of mounting a second outer button on a second surface of the container proximate the closure assembly and opposite the first outer button. The step of mounting the first outer button may include mating a first inner button to the first outer button. The method may further comprise the steps of providing a tag with a stem and a preventer, the first and second outer button accommodating an irreversible insertion of the stem, the first and second outer button further not accommodating an insertion of the preventer; irreversibly inserting the stem through the first outer button; and irreversibly inserting the stem into the second outer button.

DETAILED DESCRIPTION OF THE DRAWINGS

Comprehension of the present invention can be gained through reference to the drawings in conjunction with a thorough review of the following explanation. In order to facilitate a full appreciation of the invention, an overview of the preferred embodiment is initially provided. The overview is followed by more detailed explanation.

Figure 1:
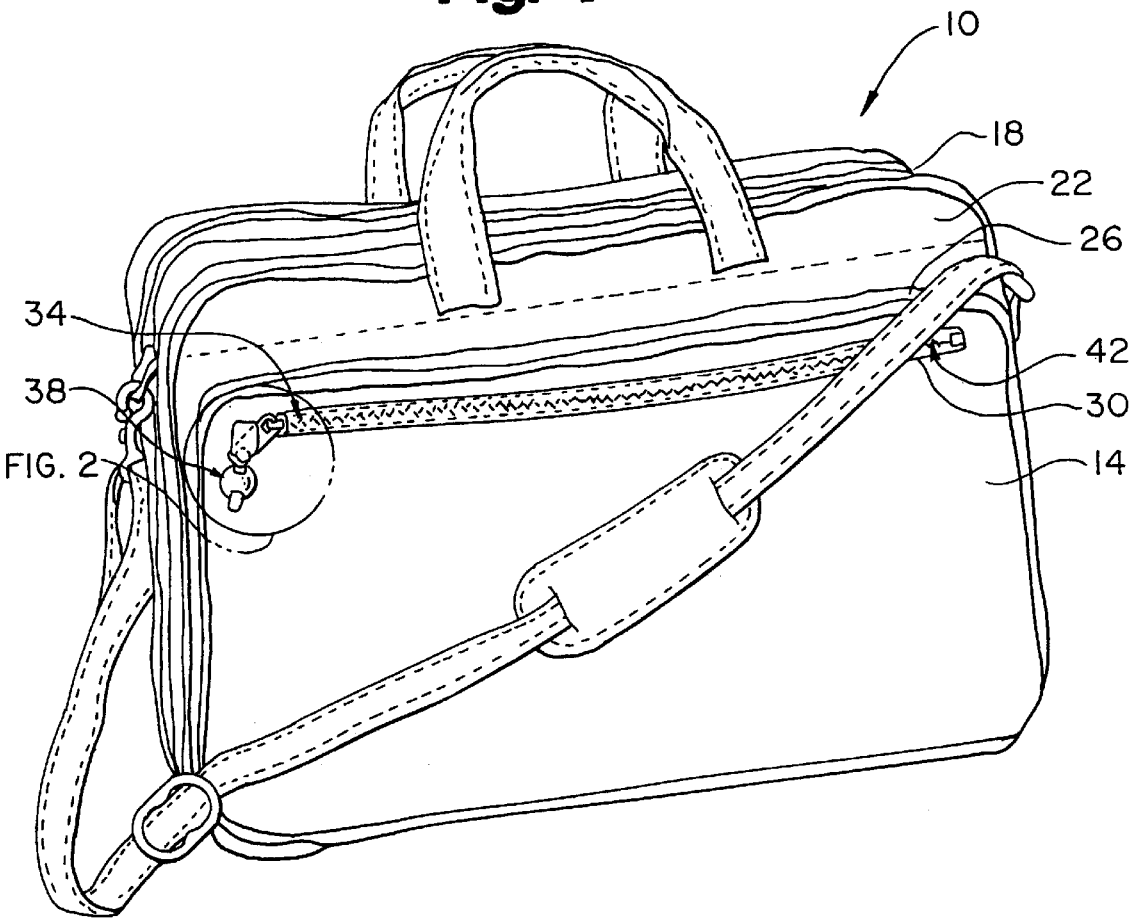
FIG. 1 is a perspective view of a container with the tamper-proof assembly of the present invention installed and employed thereon.
Figure 2:
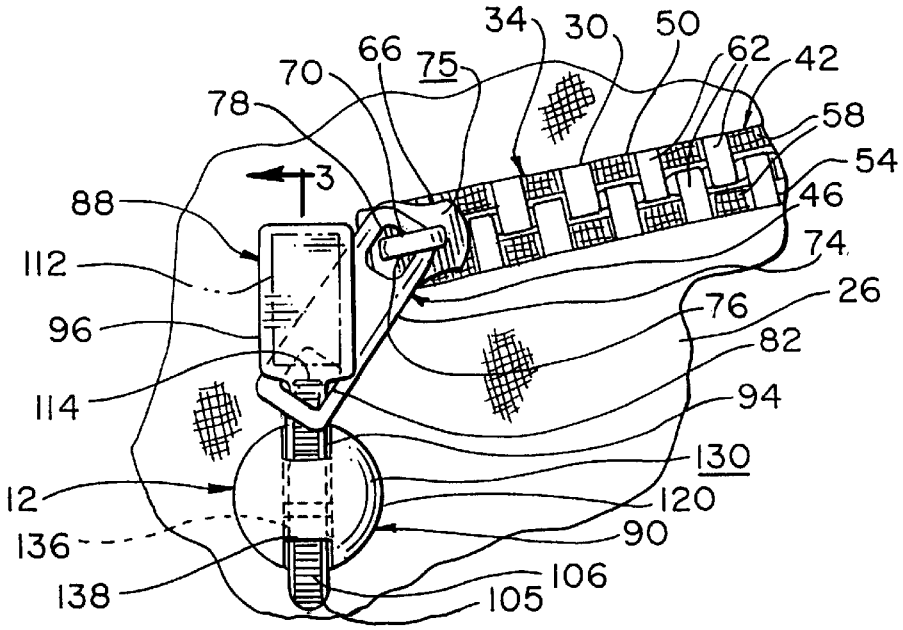
FIG. 2 is a fragmentary, enlarged view depicting the closure mechanism of the container of FIG. 1 with the tamper-proof device of the present invention installed thereon.
Figure 3:
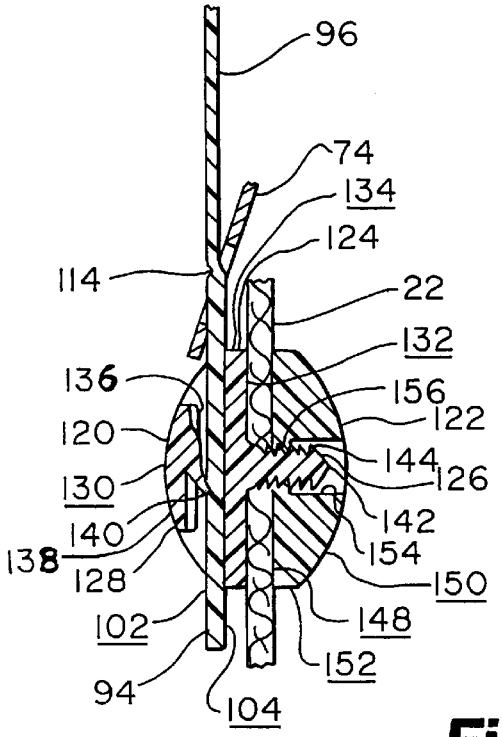
FIG. 3 is a fragmentary, side-sectional view of the tamper-proof device, installed on the container.
Figure 4:
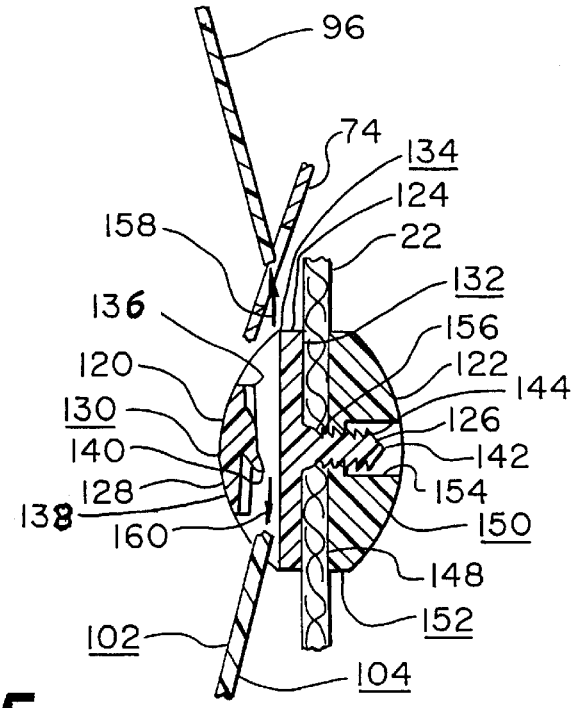
FIG. 4 is similar to FIG. 3, but with the security tag removed from the closure device.

A container, specifically a piece of luggage, employing a tamper-proof seal assembly in accordance with the present invention is depicted in the figures. The tamper-proof seal assembly operates in cooperation with closure devices such as the zipper of FIG. 1, or the hinged opening assembly depicted in FIGS. 6, 8.

Referring to the figures, container 10 may be a suitcase, a valise, a briefcase, or the like. Tamper-proof seal assembly 38 is installed on container 10. Container 10 includes closable luggage members 14, 18. Of course, one or more luggage members may be included in the closable containers of the present invention. Each closable luggage member 14, 18 includes a plurality of panels 22, at least one peripheral member 26, opening 30 and, closure assembly 34. In this embodiment, panels 22 are made of flexible materials with a desired degree of stiffness. Also in this embodiment, peripheral member 26 is bonded to each of two panels 22 about their peripheries. Bonding of peripheral member 26 to panels 22 may be accomplished by sewing, stitching, or other means known to the art. Opening 30 is present within one of panels 22. However, opening 30 could also be present within peripheral member 26.

Figure 5:
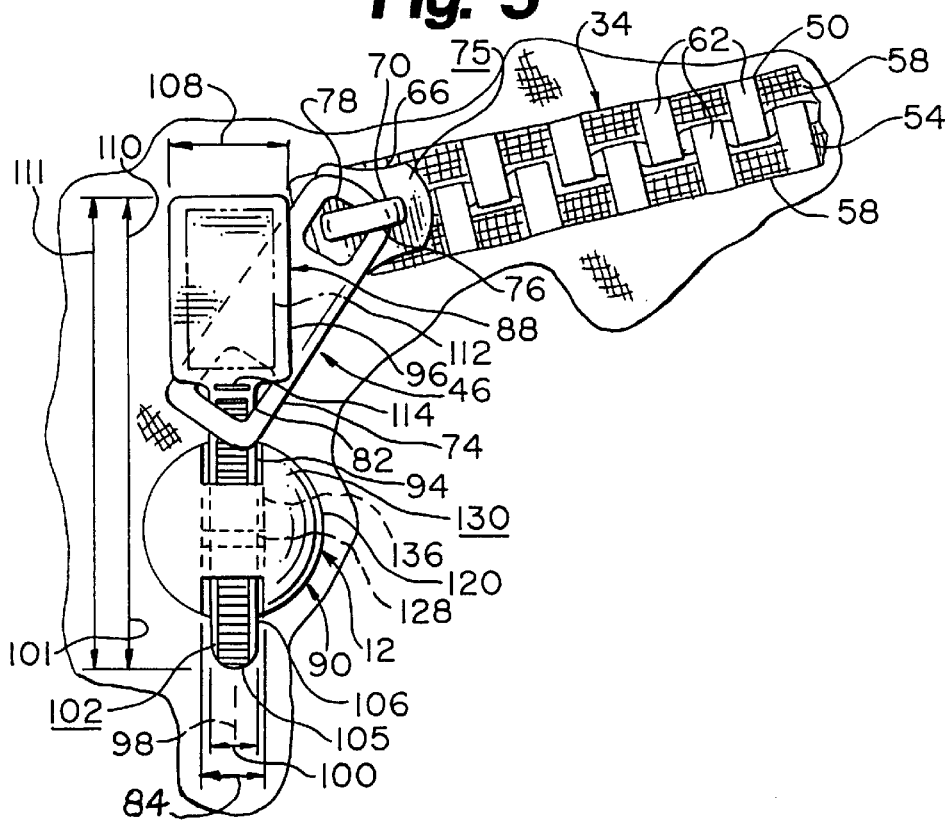
FIG. 5 is an enlarged, fragmentary view similar to FIG. 2, with various dimensions depicted thereon.

Exemplary closure assembly 34 extends across opening 30. Closure assembly 34 is a zipper in this embodiment. Closure assembly 34, in turn, includes chain 42 and closure mechanism 46. Chain 42 includes upper face 50 and lower face 54. Upper face 50 and lower face 54 each include a tape member 58 and a number of teeth 62. Teeth 62 are bonded to tape member 58 by means known to the art. Closure mechanism 46 includes slide 66, shackle 70, and pull tab 74. Slide 66 displays upper surface 75. Shackle 70 extends above upper surface 75. Shackle 70, in turn, defines opening 76 therewithin. Pull tab 74 is a generally planar member in this embodiment and defines openings 78, 82. Slide 66 functions to close and open closure assembly 34 by interlocking and separating opposing teeth 62. Opening 78 allows pull tab 74 to be affixed to shackle 70. As seen in FIG. 5, dimension 84 is the maximum span of opening 82.

Returning to FIGS. 2–5, tamper-proof seal assembly 12 includes security tag 88 and button assembly 90. Security tag 88, in turn, includes stem 94 and flag (or preventer) 96. Stem 94 may be envisioned as including longitudinal axis 98, cross sectional dimension 100 and length 101. Cross sectional dimension 100 may be generally transverse to longitudinal axis 98. In this embodiment, stem 94 displays first side 102 and second side 104 and terminates distally from flag 96 in tip 105. In this embodiment, tip 105 is generally rounded. Ribs 106 may be defined on first side 102 and extend generally transversely to longitudinal axis 98. Ribs 106 are generally serrate in cross section. Apices of ribs 106 may be angled generally toward flag 96.

Exemplary planar flag 96 is rectangular in geometry. However, various geometries for flag 96 such as circular, diamond, and square are within the scope of this invention. Dimensionally flag 96 may be envisioned as including cross sectional dimension 108 and length 110. Lengths 101 and 110 combine to form a total length 111 for security tag 88 in this embodiment. Cross section 108 may be generally transverse to longitudinal axis 98. Cross section 108 represents the longest dimension of flag 96 which is generally transverse to longitudinal axis 98. However, if flag 96 is attached to a site on stem 94 other than an end, cross section 108 would also include any maximum dimension of flag 96 which is generally transverse to longitudinal axis 98. In this embodiment flag 96 extends from an end of stem 94. However, flag 96 may be attached to stem 94 at a point other than an end thereof.

Optionally present on flag 96 is an indicia display means such as space 112. Space 112 or other indicia display means may be used advantageously for labeling stem 94 with identification, destination, or other desired information. Space 112 may also include other means for displaying indicia such as a liquid crystal display (LCD). If present, the LCD may be in communication with an electromagnetic receiver. Alternately, space 112 may be used to affix various labels preprinted with information. Security tag 88 may include a range of colors. These colors may be considered to be included in the indicia display means. In this invention the term color includes the optical properties described as clear, translucent, opaque and black. Moreover, flag 96 may assume a plurality of geometric shapes as discussed below. These shapes are included in indicia display means as well.

Stem 94 is an elongate member and is integral with flag 96 in this embodiment. Stem 94 may have a generally constant width. Exemplary fatigue score 114 represents a constricted, generally linear portion extending between stem 94 and flag 96. However, fatigue score 114 also includes other embodiments such as perforations.

In this embodiment, flag 96 is approximately 12 mm in width and about 26 mm in length. Stem 94 is approximately 5 mm in width and 48 mm in length. Security tag 88 in this embodiment is approximately 1 mm in thickness. Security tag 88 may be made of an artificial resin. However, other materials such as paperboard may be acceptable.

Button assembly 90 includes outer button 120 and inner button 122. Outer button 120 includes base portion 124, shank 126, and covering member 128. Outer button 120 is frusto-spherically shaped in this embodiment. Base portion 124 displays upper surface 130, lower surface 132, and side surface 134 and defines tunnel 136. Insert 138 is disposed in a central portion of tunnel 136. Although insert 138 is a separate piece in this embodiment, insert 138 may be integrally formed with base portion 124 as well. Ratchet 140 extends from an interior surface of insert 138. In this embodiment, ratchet 140 extends from a bottom portion of insert 138 at an angle between about 20° and 45° therefrom. Shank 126 extends generally from a central portion of lower surface 132. Shank 126 terminates in tip 142. In this embodiment, a plurality of annular ribs 144 are defined on shank 126. Annular ribs 144 are generally serrate in cross section. Other attachment alternatives to shank 126 include screws, adhesives, and rivets. If assembly 12 is a display assembly, a suitable attachment includes a magnet.

Inner button 122 displays inner surface 148, outer surface 150, and side surface 152. Exemplary inner button 122 further defines bore 154 in a generally central portion thereof. In this embodiment, constriction 156 is present at the base of bore 154, proximate inner surface 148. As in the case of outer button 120, exemplary inner button 122 is frusto-conical in shape as well.

Button assembly 90 may be made of a stiff synthetic resin. In the present embodiment, base portion 124 is approximately 22 mm in diameter, has a maximum thickness of about 7 mm and a minimum thickness of approximately 3 mm at its periphery. Shank 126 is approximately 7 mm in length and 5 mm in diameter. Ribs 144 are approximately 2 mm in length. Shank 126 may be formed separately from outer button 120. If so, a basal portion of shank 126 is embedded within outer button 120. The basal portion of shank 126 embedded within outer button 120 is approximately 14 mm in diameter and 4 mm in thickness in this embodiment.

To install tamper-proof seal assembly 12, a circular opening is made in panel 22. This circular opening should be situated such that button assembly 90 is proximate opening 82 of pull tab 74 when closure assembly 34 is in a closed configuration. Shank 126 is then pushed through the circular opening in panel 22. If shank 126 is made of a sufficiently rigid material, shank 126 may be used directly to pierce panel 22. Outer button 120 is then rotated until ratchet 140 points away from pull tab 74. Inner button 122 is then installed on the opposite side of panel 22. To install inner button 122, bore 154 is aligned with shank 126. Outer button 120 and inner button 122 are then pressed together, thereby forcing shank 126 into bore 154 and annular ribs 144 through constriction 156. Shank 126 is thus securely held within bore 154 by the cooperation of ribs 144 and constriction 156. An adhesive may also be applied to respective surfaces 132, 148, of outer button 120 and inner button 122 further securing them in place.

In use, the tamper-proof seal assembly is installed as described above. Security tag 88 is installed by inserting stem 94 through opening 82. Alternatively, stem 94 may be inserted through opening 76. Stem 94 is further inserted through tunnel 136. During insertion, ribs 106 repeatedly engage and displace the tip of ratchet 140. Stem 94 is thus inserted until stem 94 is snugly against pull tab 74. In this position, stem 94 may not be withdrawn from tunnel 136 due to the orientation of ratchet 140 against a rib 106. Thus, ratchet 140 accommodates an irreversible insertion of stem 94. The present tamper-proof seal assembly is now installed. To remove the tamper-proof seal assembly, flag 96 is grasped and bent away from, then toward pull tab 74 repeatedly. After a series of bendings, flag 96 will separate from stem 94 along fatigue score 114 in the direction of arrow 158. Stem 94 may now be withdrawn from tunnel 136 by pulling separated stem 94 away from pull tab 74 in the direction of arrow 160.

Figure 6:
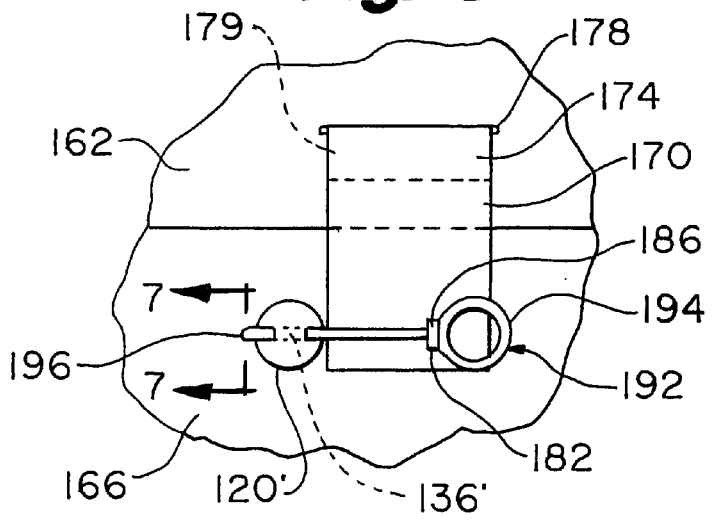
FIG. 6 is a fragmentary, plan view of another embodiment of the tamper-proof device FIG. 2.
Figure 7:
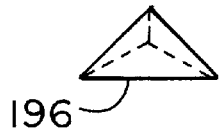
FIG. 7 is a cross section of the stem of FIG. 6 taken along line 7—7.

Two alternate embodiments to tamper-proof seal assembly 12 are depicted in FIGS. 6–9. Referring to FIG. 6, two panels 162 and 166 cooperate to partially define a cavity for storing luggage, files, or other desired materials. Panels 162 and 166 are hinged apart when opened. Another closure assembly, hasp 170, is installed on panel 162. Hasp 170 includes a plate 174 mounted on a hinge 178. Hinge 178, in turn, is affixed to plate 179. Plate 179 is affixed to panel 162. Plate 174 spans portions of panels 162, 166. Defined within plate 174 is slot 182. Staple 186 is affixed to panel 166 and extends through slot 182 when plate 174 is in a closed position. Outer button 120' and inner button 122 (not shown) are installed on panel 166 as described above such that outer button 120' is proximate to plate 174 and such that ratchet 140 is oriented away therefrom. Security tag 192 includes circular flag 194 and stem 196. Exemplary stem 196 is triangular in cross section as seen in FIG. 7. Ribs may be present on one or more surfaces of stem 196. Tunnel 136' of outer button 120' is triangular in cross section to accommodate stem 196. Ratchets (not shown) may be extend from the sides forming tunnel 136'.

Figure 8:
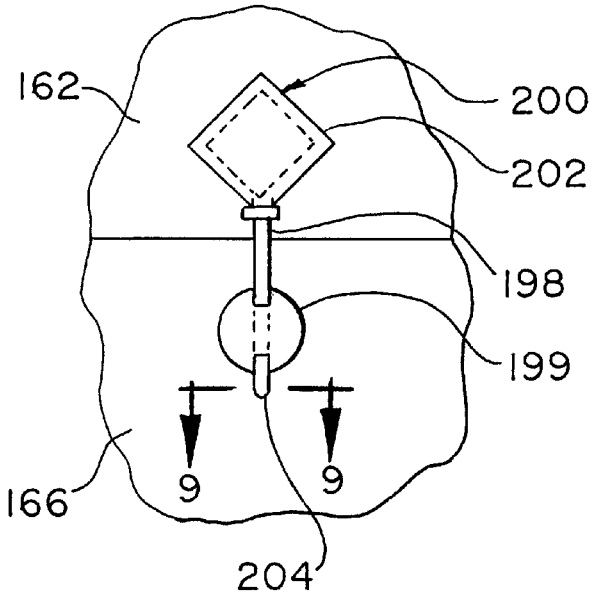
FIG. 8 is a fragmentary plan view of still another embodiment of the tamper-proof device of FIG. 2.
Figure 9:
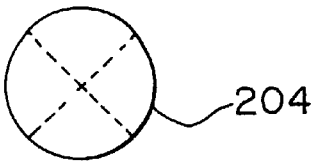
FIG. 9 is a cross sectional view of the embodiment of FIG. 8 taken along line 9—9.

Still another embodiment of tamper-proof seal assembly 12 is depicted in FIGS. 8, 9 and includes staple 198, button assembly 199 and security tag 200. Staple 198 is affixed to panel 162. Button assembly 199 is affixed to panel 166 as described above. In this embodiment, security tag 200 includes diamond-shaped flag 202 and cylindrical stem 204, as shown in FIG. 9. The tunnel present within button assembly 199 is circular in cross section (not shown) to accommodate this confirmation. A series of annular ribs (not shown) may extend around the circumference of stem 204.

Figure 10:
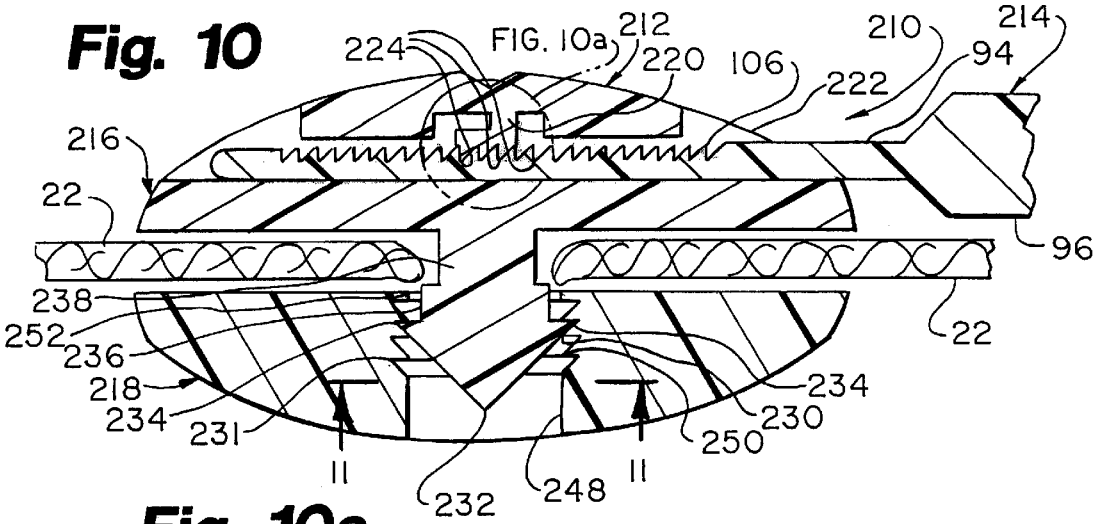
FIG. 10 is a cross sectional view of an alternate embodiment of the tamper proof device of FIG. 3.
Figure 10A:
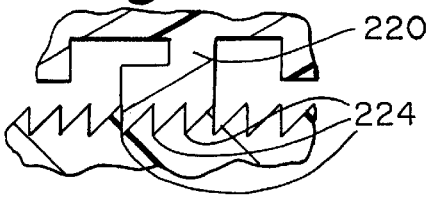
Figure 11:
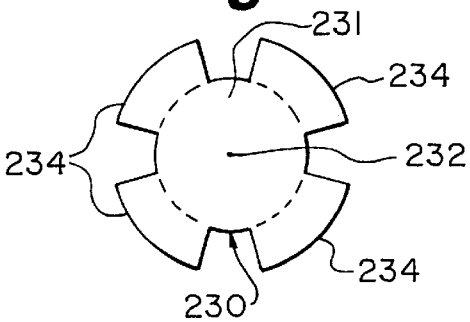
FIG. 11 is a plan view of the tip of the shank of the embodiment of FIG. 10 taken along lines 11—11.

Tamper proof seal assembly 210 is depicted in FIGS. 10, 11 as being mounted on panel 22. Tamper-proof seal assembly includes button assembly 212 and security tag 214. Button assembly 212 further includes outer button 216 and inner button 218. Ratchet 220 may be disposed proximate an upper portion of outer button 216 in a similar manner as previously discussed ratchet embodiments. Tunnel 222 may also be defined in outer button 216 as in previous embodiments as well. In contrast to previous embodiments ratchet 220 includes a multiplicity of ribs 224 when viewed cross sectionally. Ribs 224 will be more fully discussed below.

Exemplary shank 230 extends from a lower surface of outer button 216. Distal portion 231 of shank 230 terminates in pointed tip 232. Distal portion 231 tapers away from tip 232 and terminates proximally in a multiplicity of flange extensions 234. Shank 230 defines first recessed portion 236 proximal to flange extensions 234 and second recessed portion 238 proximal to first recessed portion 236.

Inner button 218 defines bore 248 in such a way that a plurality of annular ribs 250 extend inwardly therefrom. Bore 248 is also defined such that annular constriction 252 is present proximate a basal portion within bore 248.

Security tag 214 may be constructed in a similar manner as security tag 88 and thus includes stem 94 and flag 96. A multiplicity of ribs 106 may be present on a surface of stem 94. Other features present on security tag 88 may be present on tag 214 as well.

In use, button assembly 212 is mounted on panel 22 by using shank 230 to pierce the material of which panel 22 is made. Tip 232 is then aligned with bore 248 and forced therewithin. Flanges 234 cooperate with annular ribs 250 to secure shank 230 within bore 248. Security tag 214 may be inserted into tunnel 222 in such a manner that ribs 106 on stem 94 engage ribs 224 on ratchet 220. Ribs 106, 224 may be formed such that each rib includes a vertical and a slanted side when viewed in cross section. Ribs 106, 224 are ideally constructed such that they slidingly mesh when tag 214 is inserted within tunnel 222. Vertical sides of ribs 106, 224 are formed such that they will be proximate to corresponding slanted sides with respect to flag 96. Because of the relative orientations of the vertical and slanted sides of ribs 106, 224, security tag 214 may be irreversibly inserted into tunnel 222.

Figure 13:
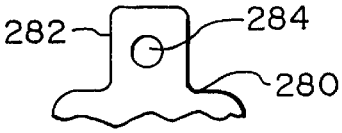
FIG. 13 is a side plan view of the aperature device of FIG. 12.
Figure 12:
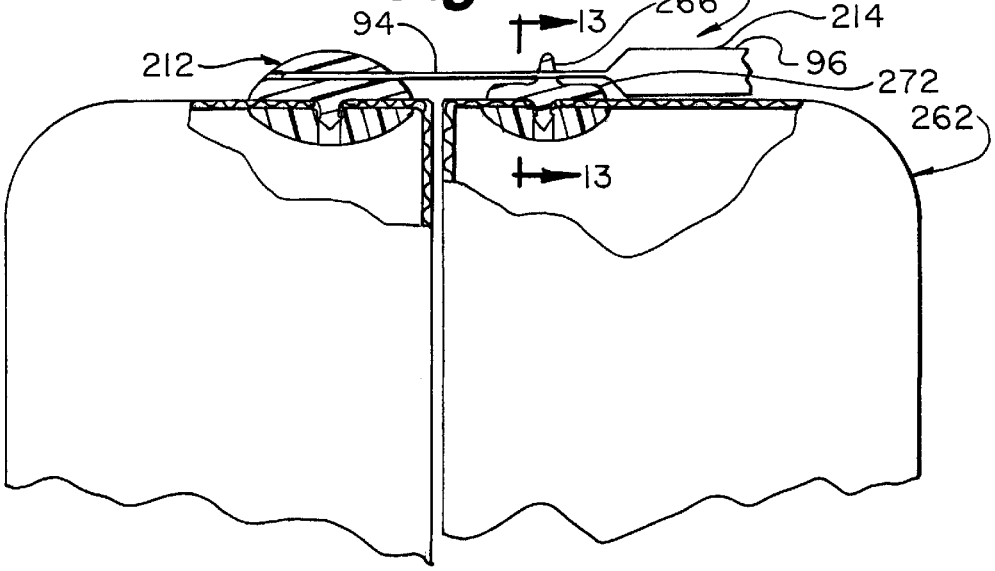
FIG. 12 is a cross sectional fragmentary view of yet another embodiment of the temper proof device of FIG. 3 installed on a hinged container.

FIGS. 12, 13 depict another embodiment of the security tag assembly of the present invention. Exemplary security tag assembly 260 is mounted on container 262. Security tag assembly 260 may include button assembly 212 and holder 266. Holder 266, further includes outer button 268 and inner button 270. Outer button 268 includes upper portion 272 and shank 274. Upper portion 272, in turn, includes basal portion 280 and lip portion 282. Basal and lip portions 280, 282 cooperate to define bore 284. Shank 274 and inner button 270 may be constructed in a similar manner as any skank and inner button embodiment discussed above.

Container 262 may include container portions 290, 292. Portions 290 and 292 may be hingeably joined as known in the art opposite assembly 260. In use, button assembly 212 and holder 266 are installed on container 262 in a similar manner as described for other embodiments of the present invention. However, stem 94 of tag 214 is passed through bore 284 before being inserted into tunnel 222. Ideally, flag 96 will not pass through bore 284. Thus, container 262 is sealed thereby such that opening container 262 must require severing stem 94 and is therefore readily detectible.

The cross sectional dimension (maximum width) 108 of any of the flags depicted herein exceeds opening (maximum opening width) 84 of pull tab 74. Dimension (maximum opening width) 84 may be present within opening 82 or be defined by staples 186, 198. Moreover, dimension 100 of any stem described herein may be less than dimension 108 and is accommodated within tunnel 136. The maximum length 101 of any stem described herein is sufficient to enable the stem to extend through opening 82 or the openings defined by staples 186, 198 and through any of the tunnels described herein.

Mounting and use of these embodiments would be straight forward in view of the descriptions of the mounting and use of tamper-proof assembly 12.

Because numerous modifications may be made of this invention without departing from the spirit thereof, the scope of the invention is not to be limited to the embodiments illustrated and described. Rather, the scope of the invention is to be determined by appended claims and their equivalents.

What is claimed is:

1. A security tag assembly adapted for use with a container, the container having a first member and a second member including structure defining an aperture, said second member shiftable between an open orientation relative to said first member and a closed orientation relative to said first member, comprising:

a tag including a stem and a preventer, the stem removably receivable through said container second member aperture; and the preventer being operably coupled to the stem, said preventer being not receivable through said aperture; and a tag receiving assembly including a securing element and a tag receiving fastener, the securing element adapted for fixedly, operably permanently attaching said tag receiving assembly to said container first member; and the tag receiving fastener having an aperture for operably, irreversibly receiving said stem therethrough, said stem being unidirectionally removable from said receiving assembly only after severence of said preventer from said stem.

2. A security tag assembly for securing the closure of a first member relative to a second member, comprising:

a first tag including a stem with a cross sectional dimension, and a preventer for operable engagement with said second member, with a cross sectional dimension, a longitudinal axis of the stem being generally transverse to the cross sectional dimension of said stem and the cross sectional dimension of said preventer, the cross sectional dimension of said stem being less than the cross sectional dimension of the preventer; and a tag receiving structure for unidirectionally receiving said stem therethrough, the tag receiving structure further configured to be fixedly, operably, permanently attached to said first member independent of the receipt of said stem within said tag receiving structure.

3. The security tag assembly of claim 2, the tag receiving structure including a ratchet.

4. The security tag assembly of claim 2, the tag receiving structure further comprising an outer button.

5. The security tag assembly of claim 4, the outer button further comprising means for attachment.

6. The security tag assembly of claim 5, the outer button attachment means comprising a shank extending from the outer button.

7. The security tag assembly of claim 4, the tag receiving structure further comprising an inner button with means for engaging the outer button.

8. The security tag assembly of claim 7, the outer button engaging means comprising a bore defined by the inner button and an annular ratchet defined by a constriction of the bore.

9. The security tag assembly of claim 2, the preventer further comprising means for displaying indicia.

10. The security tag assembly of claim 9, the indicia displaying means selected from the group consisting of an erasable exterior surface, a pre-printed exterior surface, an exterior surface accommodating the markings of a marking instrument, a surface accommodating affixation of a pre-printed label, an image, a liquid crystal display, a flat exterior surface, and any combination thereof.

11. The security tag assembly of claim 2, further comprising a second tag, the first tag including a first color and the second tag including a second color.

12. The security tag assembly of claim 2, further comprising a second tag including a preventer, the preventer of the first tag with a first geometry and the preventer of the second tag with a second geometry.

13. The security tag assembly of claim 2, the first tag further comprising means for separating the preventer from the stem, the separating means disposed between the preventer and the stem.

14. The security tag assembly of claim 13, in which the separating means is selected from the group consisting of a scoring, a perforation, a constriction, and any combination thereof.

15. The security tag assembly of claim 2, the stem further comprising a plurality of ribs disposed on a surface of the stem, the ribs extending generally transversely to a stem longitudinal axis.

* * * * *